US011395998B2

(12) United States Patent
Surjaatmadja et al.

(10) Patent No.: US 11,395,998 B2
(45) Date of Patent: Jul. 26, 2022

(54) LOADING AND UNLOADING OF MATERIAL CONTAINERS

(71) Applicant: Halliburton Energy Services, Inc., Houston, TX (US)

(72) Inventors: Jim Basuki Surjaatmadja, Duncan, OK (US); Tim H. Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 237 days.

(21) Appl. No.: 16/756,419

(22) PCT Filed: Dec. 5, 2017

(86) PCT No.: PCT/US2017/064737
§ 371 (c)(1),
(2) Date: Apr. 15, 2020

(87) PCT Pub. No.: WO2019/112570
PCT Pub. Date: Jun. 13, 2019

(65) Prior Publication Data

US 2020/0330941 A1 Oct. 22, 2020

(51) Int. Cl.
*B65D 88/30* (2006.01)
*B01F 35/71* (2022.01)
(Continued)

(52) U.S. Cl.
CPC ..... *B01F 35/7164* (2022.01); *B01F 33/5023* (2022.01); *B01F 35/71731* (2022.01);
(Continued)

(58) Field of Classification Search
CPC ..... B01F 35/7164; B65D 88/30
See application file for complete search history.

(56) References Cited

U.S. PATENT DOCUMENTS 710,611 A 10/1902 Ray
917,646 A 4/1909 Otto
(Continued)

FOREIGN PATENT DOCUMENTS

CN 201404653 Y 2/2010
EP 2937826 A1 10/2015
(Continued)

OTHER PUBLICATIONS

International Search Report and Written Opinion issued in related PCT Application No. PCT/US2017/064737 dated Sep. 4, 2018, 17 pages.

*Primary Examiner* — Jonathan Snelting
(74) *Attorney, Agent, or Firm* — Conley Rose, P.C.; Rodney B. Carroll

(57) ABSTRACT

A site may require that multiple containers, such as bulk material containers, may be utilized to provide a required composition or mixture of materials at a required discharge rate. An arrangement of four or more containers on a frame disposed on a support platform where two faces of each container proximate or adjacent to a face of two other containers to form a rectangle provides a configuration that allows for safe and efficient removal and replacement of containers A rotary table coupled to a motor disposed on the support platform rotates the frame such that each container transitions to different positions. The containers discharge material through an opening of support platform. Containers may be retrieved from one position and replaced at another position or retrieved and replaced from a single position. Such a configuration allows for multiple transport devices to operate without interfering with the operations of each other.

30 Claims, 6 Drawing Sheets

(51) Int. Cl.
*B01F 33/502* (2022.01)
*B01F 101/49* (2022.01)

(52) U.S. Cl.
CPC ..... *B01F 35/71805* (2022.01); *B65D 88/30* (2013.01); *B01F 2101/49* (2022.01)

(56) References Cited

U.S. PATENT DOCUMENTS 1,462,649 A * 7/1923 Maclellan ..... B01F 35/88 222/311
2,231,911 A 2/1941 Hitt et al.
2,385,245 A 9/1945 Willoughby
2,513,012 A 6/1950 Dugas
2,563,470 A 8/1951 Kane
2,652,174 A 9/1953 Shea
2,670,866 A 3/1954 Glesby
2,678,737 A 5/1954 Mangrum
2,802,603 A 8/1957 McCray
2,867,336 A 1/1959 Soldini et al.
3,049,248 A 8/1962 Heltzel et al.
3,083,879 A 4/1963 Coleman
3,151,779 A 10/1964 Rensch et al.
3,203,370 A 8/1965 Friedrich et al.
3,318,473 A 5/1967 Jones et al.
3,343,688 A 9/1967 Ross
3,354,918 A 11/1967 Coleman
3,432,151 A 3/1969 O'Loughlin et al.
3,476,270 A 11/1969 Cox et al.
3,602,400 A 8/1971 Cooke
3,698,693 A 10/1972 Poncet
3,785,534 A 1/1974 Smith
3,802,584 A 4/1974 Sackett, Sr. et al.
3,986,708 A 10/1976 Heltzel et al.
4,023,719 A 5/1977 Noyon
4,058,239 A 11/1977 Van Mill
4,178,117 A 12/1979 Brugler
4,204,773 A 5/1980 Bates
4,258,953 A 3/1981 Johnson
4,313,708 A 2/1982 Tiliakos
4,398,653 A 8/1983 Daloisio
4,544,279 A 10/1985 Rudolph
4,626,166 A 12/1986 Jolly
4,701,095 A 10/1987 Berryman et al.
4,850,702 A 7/1989 Arribau et al.
4,856,681 A 8/1989 Murray
4,900,157 A 2/1990 Stegemoeller et al.
4,956,821 A 9/1990 Fenelon
4,993,883 A 2/1991 Jones
5,036,979 A 8/1991 Selz
5,096,096 A 3/1992 Calaunan
5,149,192 A 9/1992 Hamm et al.
5,339,996 A 8/1994 Dubbert et al.
5,375,730 A 12/1994 Bahr et al.
5,413,154 A 5/1995 Hurst, Jr. et al.
5,426,137 A 6/1995 Allen
5,441,321 A 8/1995 Karpisek
5,445,289 A 8/1995 Owen
5,590,976 A 1/1997 Kilheffer et al.
5,722,552 A 3/1998 Olson
5,913,459 A 6/1999 Gill et al.
5,927,356 A 7/1999 Henderson
5,944,470 A 8/1999 Bonerb
5,997,099 A 12/1999 Collins
6,059,372 A 5/2000 McDonald et al.
6,193,402 B1 2/2001 Grimland et al.
6,247,594 B1 6/2001 Garton
6,491,421 B2 12/2002 Rondeau et al.
6,517,232 B1 2/2003 Blue
6,536,939 B1 3/2003 Blue
6,537,015 B2 3/2003 Lim et al.
6,568,567 B2 5/2003 McKenzie et al.
6,622,849 B1 9/2003 Sperling
7,008,163 B2 3/2006 Russell
7,086,342 B2 8/2006 O'Neall et al.
7,100,896 B1 9/2006 Cox
7,252,309 B2 8/2007 Eng Soon et al.
7,284,579 B2 10/2007 Elgan
7,475,796 B2 1/2009 Garton
7,500,817 B2 3/2009 Furrer et al.
7,762,281 B2 7/2010 Schuld
7,997,213 B1 8/2011 Gauthier et al.
8,387,824 B2 3/2013 Wietgrefe
8,434,990 B2 5/2013 Claussen
D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 11/2013 Oren
8,607,289 B2 12/2013 Brown et al.
8,616,370 B2 12/2013 Allegretti et al.
8,622,251 B2 1/2014 Oren
8,668,430 B2 3/2014 Oren et al.
D703,582 S 4/2014 Oren
8,827,118 B2 9/2014 Oren
8,834,012 B2 9/2014 Case et al.
8,887,914 B2 11/2014 Allegretti et al.
RE45,713 E 10/2015 Oren et al.
9,162,603 B2 10/2015 Oren
RE45,788 E 11/2015 Oren et al.
9,227,780 B2 * 1/2016 Krohn ..... E21B 21/01
9,248,772 B2 2/2016 Oren
RE45,914 E 3/2016 Oren et al.
9,296,518 B2 3/2016 Oren
9,340,353 B2 5/2016 Oren et al.
9,358,916 B2 6/2016 Oren
9,394,102 B2 7/2016 Oren et al.
9,403,626 B2 8/2016 Oren
9,421,899 B2 8/2016 Oren
9,440,785 B2 9/2016 Oren et al.
9,446,801 B1 9/2016 Oren
9,475,661 B2 10/2016 Oren
9,511,929 B2 12/2016 Oren
9,522,816 B2 12/2016 Taylor
9,527,664 B2 12/2016 Oren
9,580,238 B2 2/2017 Friesen et al.
RE46,334 E 3/2017 Oren et al.
D780,883 S 3/2017 Schaffner et al.
D783,771 S 4/2017 Stegemoeller et al.
D783,772 S 4/2017 Stegemoeller, III et al.
9,617,065 B2 4/2017 Allegretti et al.
9,617,066 B2 4/2017 Oren
9,624,030 B2 4/2017 Oren et al.
9,624,036 B2 4/2017 Luharuka et al.
9,643,774 B2 5/2017 Oren
9,650,216 B2 5/2017 Allegretti
9,656,799 B2 5/2017 Oren et al.
9,669,993 B2 6/2017 Oren et al.
9,670,752 B2 6/2017 Glynn et al.
9,676,554 B2 6/2017 Glynn et al.
9,682,815 B2 6/2017 Oren
9,694,970 B2 7/2017 Oren et al.
9,701,463 B2 7/2017 Oren et al.
9,718,609 B2 8/2017 Oren et al.
9,718,610 B2 8/2017 Oren
9,725,233 B2 8/2017 Oren et al.
9,725,234 B2 8/2017 Oren et al.
9,738,439 B2 8/2017 Oren et al.
RE46,531 E 9/2017 Oren et al.
9,758,081 B2 9/2017 Oren
9,758,993 B1 9/2017 Allegretti et al.
9,771,224 B2 9/2017 Oren et al.
9,783,338 B1 10/2017 Allegretti et al.
9,796,504 B1 10/2017 Allegretti et al.
9,828,135 B2 11/2017 Allegretti et al.
9,840,366 B2 12/2017 Oren et al.
9,988,182 B2 6/2018 Allegretti et al.
10,189,599 B2 1/2019 Allegretti et al.
10,287,091 B2 5/2019 Allegretti
10,308,421 B2 6/2019 Allegretti
10,486,854 B2 11/2019 Allegretti et al.
10,569,242 B2 * 2/2020 Stegemoeller ..... B65D 88/32

(56) References Cited

U.S. PATENT DOCUMENTS

| | | | |
|---|---|---|---|
| 10,604,338 | B2 | 3/2020 | Allegretti |
| 2003/0159310 | A1 | 8/2003 | Hensley et al. |
| 2004/0008571 | A1 | 1/2004 | Coody et al. |
| 2005/0219941 | A1 | 10/2005 | Christenson et al. |
| 2005/0247730 | A1 | 11/2005 | Post |
| 2008/0187423 | A1 | 8/2008 | Mauchle |
| 2009/0078410 | A1 | 3/2009 | Krenek et al. |
| 2009/0129903 | A1 | 5/2009 | Lyons, III |
| 2009/0314791 | A1 | 12/2009 | Hartley et al. |
| 2012/0017812 | A1 | 1/2012 | Renyer et al. |
| 2012/0037231 | A1 | 2/2012 | Janson |
| 2013/0186514 | A1 | 7/2013 | Zhuang et al. |
| 2013/0284729 | A1 | 10/2013 | Cook et al. |
| 2013/0318934 | A1 | 12/2013 | Stutzman et al. |
| 2014/0020765 | A1 | 1/2014 | Oren |
| 2014/0023463 | A1 | 1/2014 | Oren |
| 2014/0023465 | A1 | 1/2014 | Oren et al. |
| 2014/0083554 | A1 | 3/2014 | Harris |
| 2014/0377042 | A1 | 12/2014 | McMahon |
| 2015/0003955 | A1 | 1/2015 | Oren et al. |
| 2015/0183578 | A9 | 7/2015 | Oren et al. |
| 2015/0191318 | A1 | 7/2015 | Martel |
| 2015/0284194 | A1 | 10/2015 | Oren et al. |
| 2015/0368037 | A1 | 12/2015 | Oren |
| 2015/0368052 | A1 | 12/2015 | Sheesley |
| 2015/0375930 | A1 | 12/2015 | Oren et al. |
| 2016/0031658 | A1 | 2/2016 | Oren et al. |
| 2016/0039433 | A1 | 2/2016 | Oren et al. |
| 2016/0046438 | A1 | 2/2016 | Oren et al. |
| 2016/0046454 | A1 | 2/2016 | Oren et al. |
| 2016/0068342 | A1 | 3/2016 | Oren et al. |
| 2016/0130095 | A1 | 5/2016 | Oren et al. |
| 2016/0207699 | A1 | 7/2016 | Oren et al. |
| 2016/0244279 | A1 | 8/2016 | Oren et al. |
| 2016/0264352 | A1 | 9/2016 | Oren |
| 2016/0332809 | A1 | 11/2016 | Harris |
| 2016/0332811 | A1 | 11/2016 | Harris |
| 2016/0355346 | A1 | 12/2016 | Glynn et al. |
| 2016/0376104 | A1 | 12/2016 | Glynn et al. |
| 2017/0129696 | A1 | 5/2017 | Oren |
| 2017/0144834 | A1 | 5/2017 | Oren et al. |
| 2017/0190523 | A1 | 7/2017 | Oren et al. |
| 2017/0190526 | A1 | 7/2017 | Oren et al. |
| 2017/0203915 | A1 | 7/2017 | Oren |
| 2017/0217671 | A1 | 8/2017 | Allegretti |
| 2017/0225883 | A1 | 8/2017 | Oren |
| 2017/0240350 | A1 | 8/2017 | Oren et al. |
| 2017/0240361 | A1 | 8/2017 | Glynn et al. |
| 2017/0240363 | A1 | 8/2017 | Oren |
| 2017/0267151 | A1 | 9/2017 | Oren |
| 2017/0283165 | A1 | 10/2017 | Oren et al. |
| 2017/0320660 | A1 | 11/2017 | Sanders et al. |
| 2017/0334639 | A1 | 11/2017 | Hawkins et al. |
| 2018/0002120 | A1 | 1/2018 | Allegretti et al. |
| 2018/0257814 | A1 | 9/2018 | Allegretti et al. |
| 2018/0369762 | A1 | 12/2018 | Hunter et al. |
| 2020/0062448 | A1 | 2/2020 | Allegretti et al. |
| 2020/0147566 | A1 | 5/2020 | Stegemoeller et al. |

FOREIGN PATENT DOCUMENTS

| | | | |
|---|---|---|---|
| GB | 2066220 | A | 7/1981 |
| GB | 2204847 | A1 | 11/1988 |
| JP | 2008239019 | A | 10/2008 |
| WO | 2008012513 | A2 | 1/2008 |
| WO | 2013095871 | A1 | 6/2013 |
| WO | 2013142421 | A1 | 9/2013 |
| WO | 2014018129 | A1 | 1/2014 |
| WO | 2014018236 | A2 | 5/2014 |
| WO | 2015119799 | A1 | 8/2015 |
| WO | 2015191150 | A1 | 12/2015 |
| WO | 2015192061 | A1 | 12/2015 |
| WO | 2016044012 | A1 | 3/2016 |
| WO | 2016160067 | A1 | 10/2016 |
| WO | 2016178691 | A1 | 11/2016 |
| WO | 2016178692 | A1 | 11/2016 |
| WO | 2016178694 | A1 | 11/2016 |
| WO | 2016178695 | A1 | 11/2016 |
| WO | 2017014768 | A1 | 1/2017 |
| WO | 2017014771 | A1 | 1/2017 |
| WO | 2017014774 | A1 | 1/2017 |
| WO | 2017027034 | A1 | 2/2017 |
| WO | 2017095423 | A1 | 6/2017 |

* cited by examiner

LOADING AND UNLOADING OF MATERIAL CONTAINERS

CROSS-REFERENCE TO RELATED APPLICATION

The present application is a U.S. National Stage Application of International Application No. PCT/US2017/064737 filed Dec. 5, 2017, which is incorporated herein by reference in its entirety for all purposes.

TECHNICAL FIELD

The present disclosure relates generally to transferring materials, such as bulk materials, and more particularly, to a container support structure for receiving, retrieval, and arrangement of containers of material and routing material from the containers.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high viscosity fluids are normally produced by mixing dry powder and/or granular materials and agents with water at the well site as they are needed for the particular treatment. Systems for metering and mixing the various materials are normally portable, for example, skid- or truck-mounted, since they are needed for only short periods of time at a well site.

The material is normally transported to a site in a commercial or common carrier tank truck, train or other vehicle. Once the tank truck and mixing system are at the site, for example, a well site, the dry powder material (bulk material) must be transferred or conveyed from the tank truck into a supply tank for metering into a blender as needed. The bulk material is usually transferred from the tank truck pneumatically. More specifically, the bulk material is blown pneumatically from the tank truck into an on-location storage/delivery system (for example, silo). The storage/delivery system may then deliver the bulk material onto a conveyor or into a hopper, which meters the bulk material through a chute into a blender tub.

To maintain the desired pressure and composition of material conveyed or pumped downhole requires arrangement, retrieval and receipt of containers. Inefficient arrangement, retrieval and receipt of containers may adversely affect an operation, for example, by delaying pumping of a mixture or composition of fluid downhole and creating hazardous conditions due to the height placement of the containers containing generally large loads of materials.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
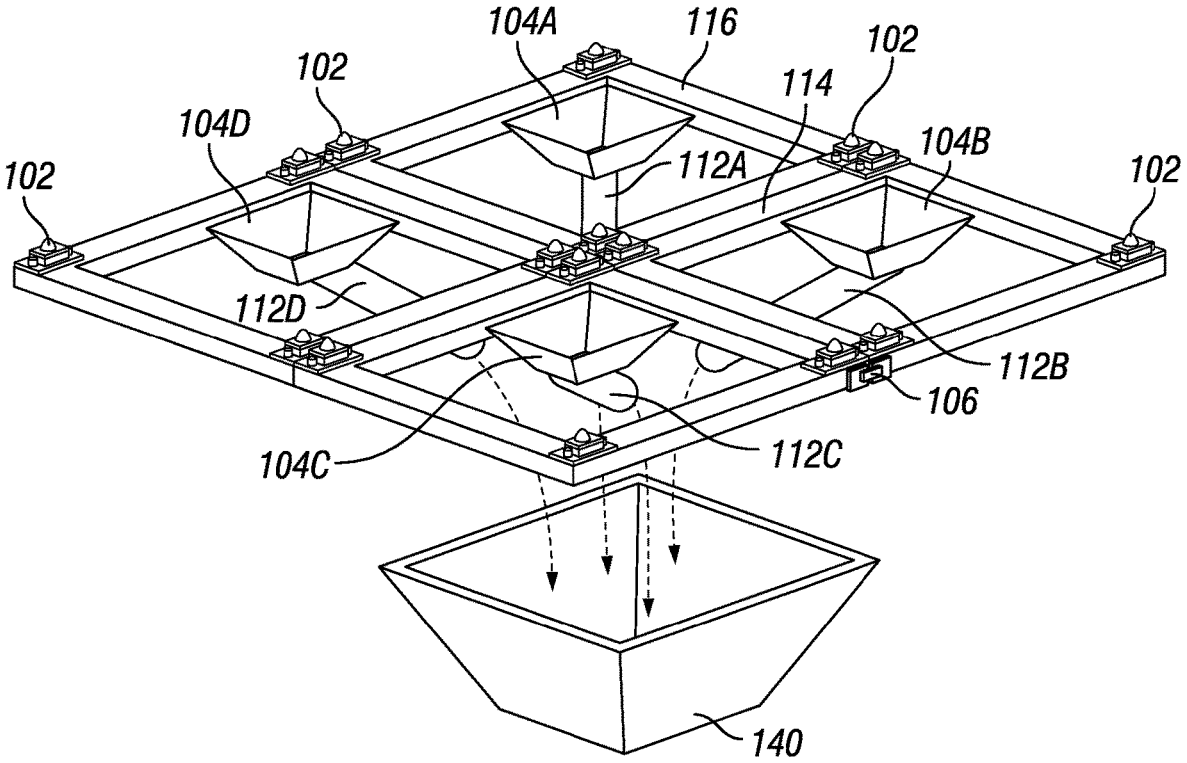
FIG. 1 illustrates a container support structure for arrangement of containers, according to one or more aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for efficiently managing material (for example, a fluid, mixture, composition, solid, liquid, any other material or any combination thereof) including but not limited to bulk material. Material handling systems are used in a wide variety of contexts including, but not limited to, drilling and completion of hydrocarbons, such as oil and gas wells, concrete mixing applications, agriculture, and others. The disclosed embodiments are directed to systems and methods for efficiently arranging, receiving and retrieving containers, for example, bulk material containers, at a site. The systems may include a container support structure used to receive one or more portable containers of bulk material and output bulk material from the containers directly into the hopper, blender inlet mixer or other mixing system. In one or more embodiments, the container support structure may be portable. The disclosed techniques may be used to efficiently handle any desirable material having a solid or liquid (dry or wet) constituency including, but not limited to, sand, proppant, gel particulate, diverting agent, dry-gel particulate, liquid additives and others.

Material handling applications may be used during the formation of treatment fluids. In such applications, the material is often transferred between transportation units, storage tanks, blenders, and other on-site components via pneumatic transfer, sand screws, chutes, conveyor belts, and other components. The containers may be brought in on trucks or other transportation units, unloaded, stored on location, and manipulated about the site when or as the material is needed. These containers may comprise a discharge gate located generally at the bottom of the container that can be actuated to empty the material contents of the container at a desired time. Each container may contain tens of thousands of pounds (lbs) or kilograms (kg). For example, a container may contain between 45,000 lbs (approximately 20,412 kg) and 50,000 lbs (approximately 22,680 kg) of material. For a given pumping stage or operation, several containers may be required to be moved from a staging or storage area to the blending system. For example, a pumping stage of 1,000,000 lbs (approximately 453,592 kg) may require that twenty-two containers be moved from a storage or staging area to the blending system. An operation or pumping stage may require that containers containing a material are moved from a staging or storage area to a blending system and that empty containers are removed and placed in a staging or storage area. A transport device, such as a forklift, may be used to arrange and otherwise transport the containers around a site. The transport device may be required to move quickly and efficiently about the site retrieving, replacing and arranging the containers such that the proper mixture and pressure of material is maintained. For example, an operation that requires 80 barrels (bbls) (approximately 12.7 meters$^3$ ($m^3$)) per minute using sand concentrations of 2 lbs/gallon (approximately 0.24 kg/liter) using a blending system with a three container arrangement would require that container replacement be complete in approximately 6.7 minutes. As there are three containers, during certain time periods the transport device could take 13.4 minutes to complete the replacement process. For such an operation, multiple transport devices could be utilized, however, precise coordination of the transport devices is required to avoid collision and delay. Additionally, in such a three container configuration the base of the containers must be at a sufficient height to allow the material of the containers to be discharged into a hopper or growler of the blending system. For example, in such a three container system the containers must be at a height of at least 10 feet (approximately 3 meters). Such heights may increase the time required for arrangement, retrieval and receipt of containers and may also create safety hazards at the job site.

One or more embodiments of the present disclosure provide systems and methods for increasing the efficiency and safety of arranging, retrieving and receiving containers, for example, bulk containers, at a site by using an arrangement of containers that allow for the containers to be accessed from a different approach and at a lower height. The material and container handling systems having the container support structure for containers disclosed herein are designed to address and eliminate the shortcomings associated with existing material and container handling systems. The container support structure may include a frame for receiving and holding one or more portable bulk material containers in an arrangement and position proximate the blender inlet (e.g., hopper, growler or mixer inlet) so as to reduce the required elevation of the containers. In some embodiments, the container support structure may be mobile or portable such that it can be transported to a site on a trailer, unloaded from the trailer, and positioned proximate the blender inlet. In other embodiments, the container support structure may be a mobile support structure that is integrated into a support platform such as a trailer. The support platform may be designed with an opening so that the blender unit can be backed up until the blender inlet of the blender unit is in position directly under the gravity feed outlet(s) of the support platform.

The disclosed container support structure may provide an elevated location for one or more containers to be placed while the material, such as proppant (or any other liquid or solid bulk material used in the fluid mixtures at the job site), is discharged from the containers to the blender inlet or hopper. The container support structure may elevate the containers to a safer and more easily accessible height above the blender inlet or hopper and route the material directly from the containers to the blender inlet or hopper.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, read only memory (ROM), or any other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data, instructions, or both for a period of time. Computer-readable media may include, for example, without limitation, storage media such as a direct access storage device (for example, a hard disk drive or floppy disk drive), a sequential access storage device (for example, a tape disk drive), compact disk, compact disk ROM (CD-ROM), digital video disc (DVD), the "CLOUD", RAM, ROM, electrically erasable programmable read-only memory (EEPROM), flash memory, biological memory, deoxyribonucleic acid (DNA) or molecular memory or any combination thereof; as well as communications media such wires, optical fibers, microwaves, radio waves, and other electromagnetic or optical carriers, or any combination of the foregoing.

FIG. 1 illustrates a container support structure 100 for arrangement of one or more containers, according to one or more aspects of the present disclosure. The container support structure 100 includes a frame 116 sized to receive and support at least four containers, although, the present disclosure contemplates any number of containers. In one or more embodiments, the frame 116 may comprise one or more frames 116 that couple to or otherwise engage each other to provide a contiguous frame that supports one or more containers. For example, in one or more embodiments, a latch 106 may couple one or more frames 116 to each other. The present disclosure contemplates one or more latches 106. Latch 106 may comprise any coupling mechanism for connecting or engaging a plurality of frames 116. The frame 116 may include one or more beams or supports 114 coupled to the frame 116 (for example, via welds, rivets or bolts). The frame 116 may include additional beams or supports 114 that function as trusses to help support the weight of the filled containers disposed on the frame 116. For example, in one or more embodiments beams or supports 114 may be coupled together to form a rectangular support for each container. Other shapes, layouts, and constructions of the frame 116 may be used in other embodiments.

As illustrated, the frame 116 may be equipped with a plurality of locator pins 102 disposed on top of the frame 116 for locating and holding a container on the frame 116. Each container may include complementary engagement features designed to interface with the locator pins 102, thus enabling a precise placement of the container into a desired location on the frame 116. In the illustrated embodiment, the locator pins 102 are generally disposed at the corners on the upper face of the frame 116. For example, a frame 116 may have corners that correspond to each corner of a corresponding container. However, other placements of the locator pins 102 along the upper surface of the frame 116 may be utilized in one or more embodiments.

The frame 116 may also include one or more receptacles or cone shaped conduit or receptacles 104 (for example, receptacles 104A, 104B, 104C and 104D, collectively referred to as receptacles 104) designed to capture materials discharged from a container and direct those materials to a mixing system 140. In one or more embodiments, the receptacles 104 may comprise any suitable shape including, but not limited to, round, cylindrical, triangular, beveled, funnel or any other shape or dimension. In one or more embodiments, the receptacles 104 may comprise a rigid material (for example, steel or fiberglass) or a pliable material (for example, rubber). In one or more embodiments, the receptacles 104 may aid in actuation of a discharge gate of the one or more containers disposed on the frame 116. The receptacles 104 may comprise rotary actuators designed to rotate into engagement with a discharge gate of a container to transition the gate between a closed position and an open position or any position in between. In other embodiments, the receptacles 104 may comprise linear actuators designed to interface with the gates of the containers to selectively open and close the gates. In some embodiments, the receptacles 104 may comprise a set of two receptacles (disposed on opposite sides of the frame 116) for actuating the discharge gate of a single container disposed on the frame 116. In such an arrangement, one of the receptacles 104 may transition the discharge gate from a closed position to an open position or any position in between, while an actuator of the opposite receptacles 104 may transition the gate from an open position to a closed position or any position in between. In one or more embodiments, the receptacles 104 may meter the discharge material to the mixing system 140.

The container support structure 100 may be transportable to and from a desired location or site on a support platform or portable support (such as a trailer, a flatbed trailer, a bed, or other portable support) or some other transportation unit, structure or support platform. Once at a location or site, a transport device or a hoisting mechanism (for example, forklift, crane, etc.) may be used to remove the container support structure 100 from the support platform and to place the container support structure 100 into a desired position. In one or more embodiments, the container support structure 100 may comprise the support platform. In one or more embodiments, the container support structure 100 may include slots that a transport device or hoisting mechanism may engage to lift and arrange the container support structure 100 about the site. In one or more embodiments, the container support structure 100 is positioned at a desired location at the site, for example, above a mixing system 140.

Figure 3:
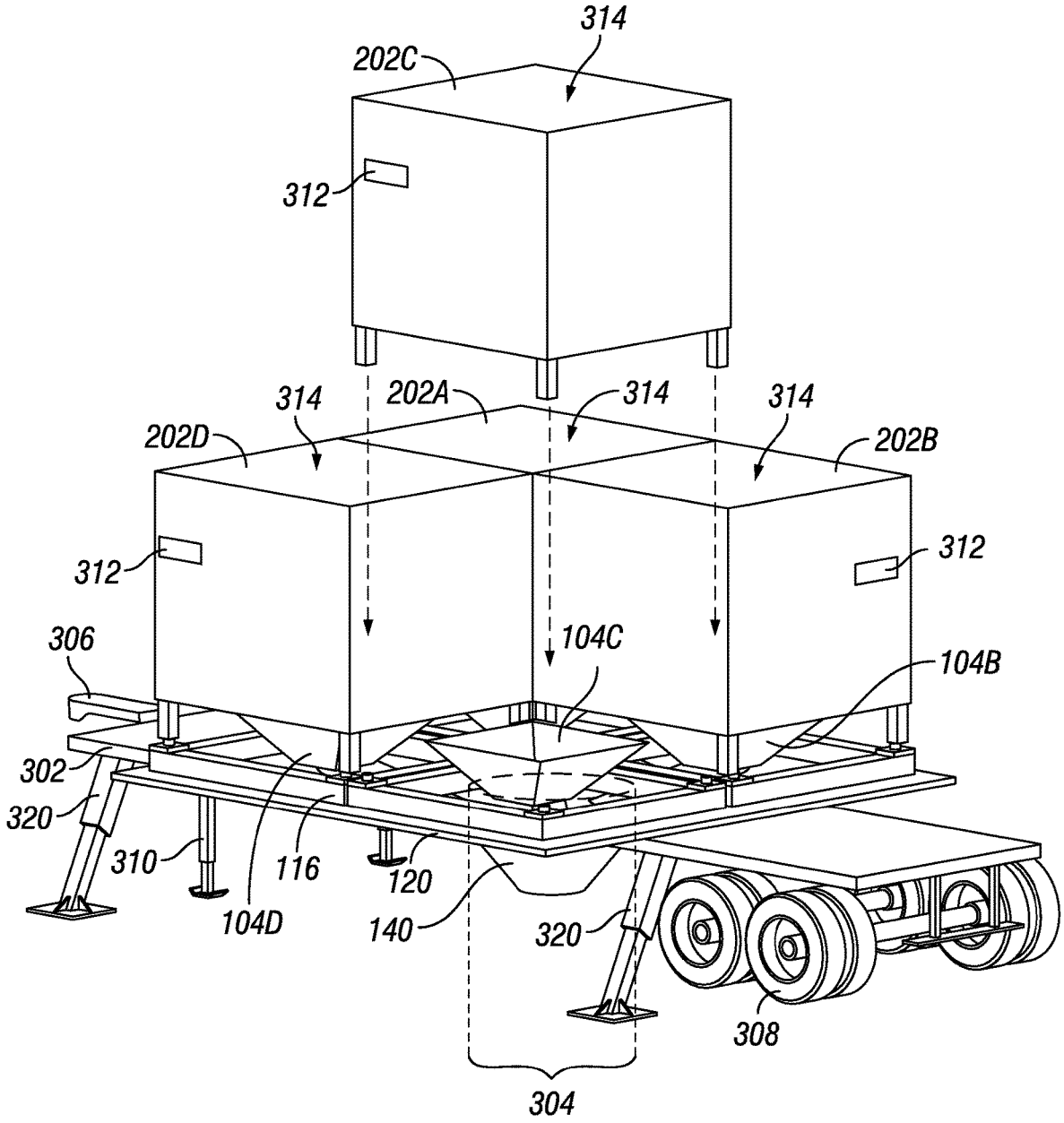
FIG. 3 is a side view of a site having a container support structure, in accordance with one or more aspects of the present disclosure.

The container support structure 100 may include one or more gravity feed outlets 112 (for example, gravity feed outlets 112A, 112B, 112C and 112D, collectively referred to as gravity feed outlets 112) for routing material directly from one or more containers disposed on the frame 116 into a mixing system 140. Mixing system 140 may comprise a blender, tub, growler, mixer, hopper or any other mixing system for holding or combining materials. In one or more embodiments the mixing system 140 may comprise a blender hopper used to provide bulk material to a metering system that meters the bulk material dispensed from the containers into a mixer. In other embodiments, the mixing system 140 may comprise an inlet directly into a mixing vessel of a blender. In one or more embodiments, a blender of a mixing system 140 may comprise any shape, for example, a round shape. In one or more embodiments, the mixing system 140 may be positioned or disposed on surface, such as the ground, a pad, a liner or any other surface or combination thereof. In one or more embodiments, the surface at a location is substantially flat or smooth to allow ease in maneuvering the transport device about the container support structure 100. This may enable the containers to discharge bulk material directly into the mixing system 140, without the containers being elevated exceedingly high. Other embodiments may utilize other types of mixing systems 140 for receiving the material or bulk material from the containers disposed on the container support structure 100. In one or more embodiments, the missing system 140 may be attached to a transportation unit or transport vehicle or to a trailer 302 as illustrated in FIG. 3.

The gravity feed outlets 112 (for example, gravity feed outlets 112A-D, collectively gravity feed outlets 112) may be used to deliver a flow of material from a container to a mixing system 140 from each container disposed on the frame 116. In one or more embodiments, the container support structure 100 may also include individual receptacles 104 at the top of the frame 116 for funneling material from the discharge gate of the corresponding containers into the gravity feed outlets 112, respectively. In one or more embodiments, a container discharges material directly to a mixing system 140 or to a gravity feed outlet 112 without the need for a receptacle 104.

The mixing system 140 (or other blender inlet, hopper, mixer or other mixing system) may be entirely separate from the container support structure 100. In one or more embodiments, the container support structure 100 and the mixing system 140 are positioned or disposed relative or proximate to one another such that the gravity feed outlets 112 freely discharge material to the mixing system 140. The gravity feed outlets 112 may be chutes positioned so that the upper end of each chute is disposed beneath a discharge gate of a corresponding container (or one of the receptacles 104) on the frame 116. The gravity feed outlets 112 may be positioned such that the lower end of each chute is disposed fully within the mixing system 140. This allows the gravity feed outlets 112 to provide material from all of the containers positioned on the frame 116 into the same mixing system 140 at the same time. The gravity feed outlets 112 are able to provide a gravity feed where an angle of repose of the material exiting the chutes is able to choke the flow of material through the chutes. As material is metered from the mixing system 140 into another portion of a system such as a blender or mixer, additional material is able to flow via gravity into the mixing system 140 directly from the one or more gravity feed outlets 112. In embodiments where the gravity feed outlets 112 are positioned to route material directly from the containers into an inlet of the mixing system 140, the gravity feed outlets 112 may comprise a metering gate or metering valve to regulate the amount of material provided into the mixing system 140. The gravity feed outlets 112 are angled such that the material is freely dispensed from the container to the mixing system 140.

Figure 2:
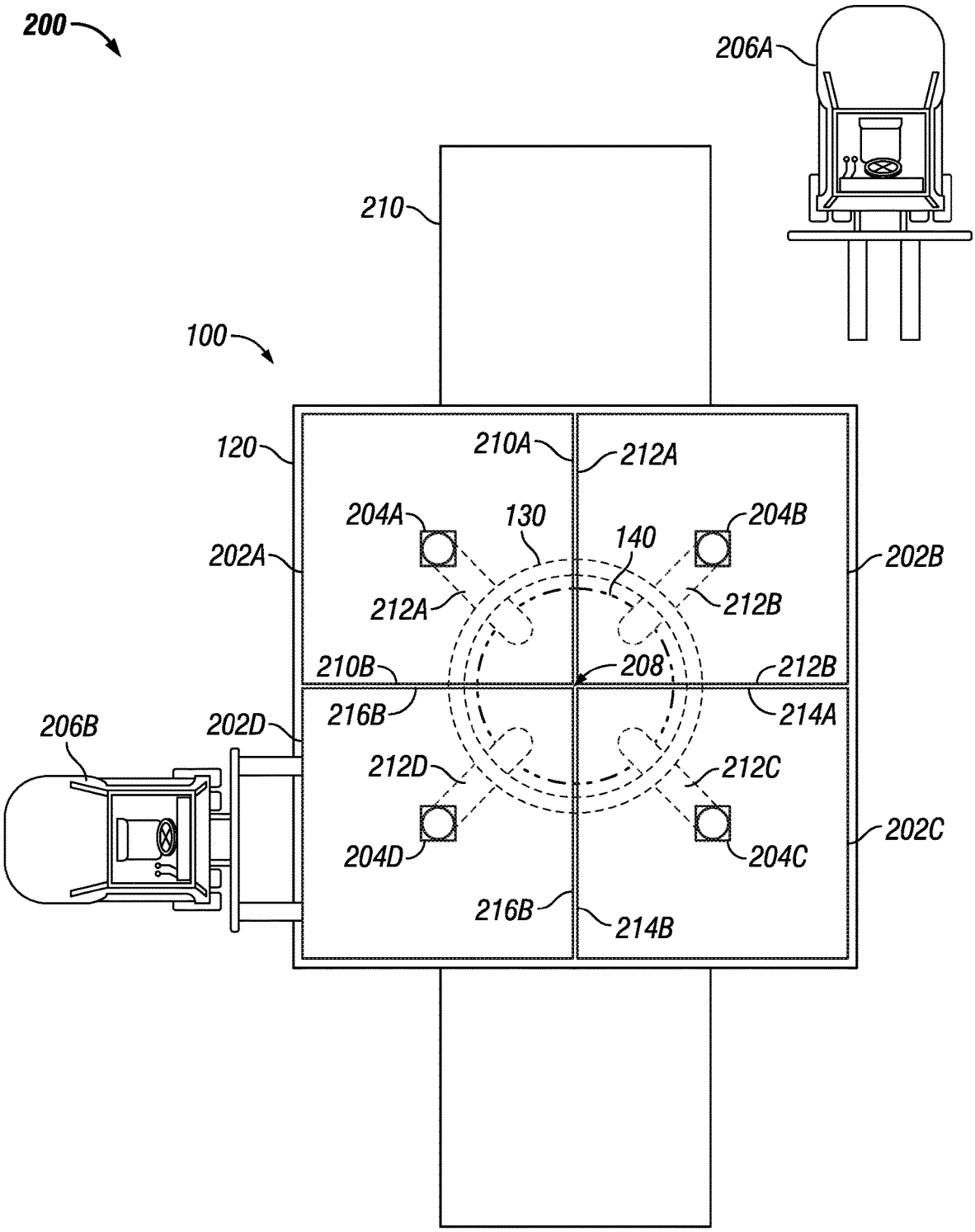
FIG. 2 is a top view of a plurality of containers arranged on a container support structure, according to one or more aspects of the present disclosure.

FIG. 2 is a top view of a plurality of containers 202 arranged or otherwise disposed or positioned on a container support structure 100 at a site 200. The container support structure 100 may comprise a support platform 210, a motor mechanism 130 and a rotary table 120. In one or more embodiments, the container 202 may comprise any one or more of the components of the container support structure 100. For example, a container 202 may comprise a frame 116. In one or more embodiments, the container support structure 100 may comprise a mixing system 140. In one or more embodiments, mixing system 140 may be part of or coupled or engaged to the support platform 210. For example, the mixing system 140 may be disposed or positioned under the support platform 210.

A rotary table 120 may be disposed, positioned, coupled or engaged at, about or to the frame 116. In one or more embodiments, the rotary table 120 may be disassembled, collapsible or foldable for ease of transportation when disposed on a support platform or trailer. For example, the rotary table 120 may collapse or fold so that the outer perimeter of rotary table 120 is within or substantially within the outer perimeter of a support platform or trailer or so that the outer perimeter of rotary table 120 extends over an outer perimeter of a support platform or trailer. In one or more embodiments, the rotary table 120 is assembled or expands or unfolds to support at least four containers as illustrated in FIG. 2. In one or more embodiments, rotary table 120 may be expandable without removing frame 116. In one or more embodiments, rotary table 120 may be expandable by lifting or disengaging frame 116 temporarily from rotary table 120. In one or more embodiments, any one or more sides of a frame 116 may fold upward during transport. In one or more embodiments, the rotary table 120 and frame 116 may be assembled on site or pivot inward about a vertical axis during transport. In one or more embodiments, rotary table 120 comprises a single sheet of material or is a composite material. In one or more embodiments, rotary table 120 comprises one or more sheets that couple to or otherwise engage each other to form an expanded rotary table 120. In one or more embodiments, the rotary table 120 may comprise a center sheet sized to width of a support platform 210 or a trailer, for example, trailer 302 of FIG. 3, or any other width. A container may have a width approximately equal to the width of the transportation unit, for example, a width of a support platform 210 or a trailer 302 and thus a rotary table 120 may comprise two half sheets that hinge together on each side of a center sheet with one or more support bars that extend below the sheets to provide additional support for the one or more containers disposed about the frame 116. The rotary table 120 may comprise the one or more support bars which rotate with the rotary table 120.

Rotary table 120 may be disposed, positioned or coupled on, about or to a motor mechanism 130. Motor mechanism 130 may comprise any type of motor that supports and rotates rotary table 120 including but not limited to an electric motor or a hydraulic motor or both. Electric motors by Dayton or Warner Electric may be used in one or more embodiments. For configurations utilizing an electric motor, sealed systems (fire deterrent) should be selected that preferably comprise built in gear reducer systems. Motors could also be hydraulic, such as hydraulic motors by Eaton or Parker. When using a hydraulic motor, use of reducers may be preferred to increase torque capacity while reducing speeds to less than 1 rotation per minute (RPM) especially given that the rotated system weight might exceed 90 metric tonnes. Motor mechanism 130 when actuated rotates rotary table 120 and frame 116 such that the containers disposed, positioned or coupled on, about or to frame 116 may be moved to a different quadrant or position for retrieval and so that replacement containers may be disposed, positioned or coupled on, about or to frame 116.

In one or more embodiments, any one or more of frame 116, rotary table 120, motor mechanism 130 or mixing system 140 may be disposed, positioned or coupled on, about or to a portable support platform 210 or trailer 302. In one or more embodiments, frame 116, rotary table 120, motor mechanism 130 and mixing system 140 are transported to a site separately and individually. In one or more embodiments, any combination of frame 116, rotary table 120, motor mechanism 130 and mixing system 140 are transported to a site on a container support platform 210 or trailer 302 as a single unit.

In one or more embodiments, the support platform 210 may be portable and may couple to or engage with a transportation unit or transport vehicle such as a train or motorized vehicle (such as a tractor, a tractor trailer, big rig, semi-tractor trailer, or any other type of truck, vehicle or transportation unit). In one or more embodiments, the motor mechanism 130 and rotary table 120 are disposed or positioned on the support platform 210 such that during transportation the motor mechanism 130 and the rotary table 120 are substantially within the outer perimeter of the support platform 210 or do not exceed the outer perimeter of the support platform 210 by an amount that would impede transportation of the container support structure 100.

In one or more embodiments, the rotary table 120 may be an expandable and collapsible rotary table or disassembled. During transport the rotary table 120 may be collapsed or disassembled and during operation the rotary table 120 may be expanded or assembled. The rotary table 120 when expanded or assembled may support at least four containers 202 (for example, containers 202A, 202B, 202C and 202D, collectively containers 202). Containers 202 are removable containers such that the containers 202 may be retrieved from and positioned or disposed on or about the support platform 210. The rotary table 120 is rotated by the motor mechanism 130. The motor mechanism 130 may be configured to rotate the rotary table 120 by 90 degrees such that the rotary table 120 rotates any one container 202 to four different positions. The motor mechanism 130 may rotate the rotary table 120 by any one or more degrees and to any one or more positions and may rotate the rotary table 120 in a clockwise direction or a counterclockwise direction. For example, the motor mechanism 130 may rotate the rotary table 120 by 90 degrees in a clockwise direction which transitions a first container 202A from a first position to a second position, transitions a second container 202B from the second position to a third position, transitions a third container 202C from the third position to a fourth position and transitions a fourth container 202D from the fourth position to the first position.

In one or more embodiments, each container 202 may couple to or engage with a frame, such as frame 116 in FIG. 1, to secure the containers 202 to the container support structure 100. In one or more embodiments, the containers 202 are arranged in a single layer, with two faces of each container 202 abutting, adjacent to or proximate to a face of two other containers 202 so as to form a rectangle such that each group of four containers 202 shares a common interface point at a respective corner. For example, containers 202A, 202B, 202C and 202D form a rectangle and share a common interface point 208 and a first face 210A of container 202A abuts, is adjacent to or is proximate to a first face 212A of container 202B and a second face 210B of container 202A abuts is adjacent to or is proximate to a second face 216B of container 202D, a second face 212B of container 202B abuts is adjacent to or is proximate to a first face 214A of container 202C, and a second face 214B of container 202C abuts is adjacent to or is proximate to a first face 216A of container 202D. Each container 202 may comprise an opening 204 (for example, openings 204A, 204B, 204C and 204D, collectively openings 204). Openings 204 may comprise a gate, valve or door that when transitions between an open position and a closed position. Openings 204 may be transitioned from a closed position to an open position or any position in between to discharge material in the respective container 202 to a mixing system 140 to provide the desired mixture or composition at the desired rate.

In one or more embodiments, a transport device or hoisting mechanism 206 (for example, hoisting mechanism 206A and hoisting mechanism 206B, collectively hoisting mechanisms 206) may be disposed or positioned at or about the site 200. In one or more embodiments, any one or more hoisting mechanisms 206 may be utilized to remove, replace and arrange one or more containers 202 at a site 200.

FIG. 3 is a side view of a site 300 having a container support structure, in accordance with one or more aspects of the present disclosure. A site 300 may comprise a container support structure such as a container support structure 100 from FIG. 1 or a support platform 210 from FIG. 2. The container support structure may comprise any one or more of a trailer 302, a motor mechanism 130, a rotary table 120, and a frame 116. The trailer 302 may be any type of support platform such as support platform 210 in FIG. 2. The trailer 302 may comprise a hitch 306 to couple or engage the trailer 302 with a transportation unit or vehicle (not shown) and a plurality of wheels 308 for ease of mobility along a transportation pathway. Trailer 302 may comprise stabilizers 310 and 320. Stabilizers 310 may extend vertically from the trailer 302 to provide support for the trailer 302 when the trailer 302 is removed from the transport vehicle. Stabilizers 320 may extend at an angle from the trailer 302 to provide additional stability, for example, horizontal stability for the trailer 302. The present disclosure contemplates any number of stabilizers 310 and 320 or any other support required to stabilize the trailer 302 during an operation or arrangement of containers 202.

The trailer 302 may support a motor mechanism 130, a rotary table 120, a frame 116 and any number of containers 202. Trailer 302, motor mechanism 130 and rotary table 120 may be of a shape and aligned such that an opening 304 of the trailer 302 allows for discharge of materials 314 from any one or more containers 202 to a mixing system 140. While opening 302 is illustrated as being circular in nature, the present disclosure contemplates and suitable shape or size of opening 302. For illustrative purposes, FIG. 3 depicts containers 202A, 202B, 202C and 202D. In one or more embodiments, any one or more containers 202 may comprise one or more sensors 312. Sensor 312 may detect one or more container parameters including but not limited a load level, a weight, a discharge rate or any other container parameter of a container 202. A load level may be indicative of the remaining material 314 in the container. A discharge rate may be indicative of the rate of discharge of material 314 from the container 202. Sensor 312 may comprise data associated with the container 202 including, but not limited to, type of material 314 and weight of material 314 in the container 202. Sensor 312 may be coupled wired or wirelessly to an information handling system, for example, information handling system 600 depicted in FIG. 6, to communicate one or more container parameters to the information handling system. In one or more embodiments, the sensor 312 may communicate one or more container parameters associated with a container 202 to an information handling system. In one or more embodiments, one or more container parameters may be communicated via a gauge or meter (not shown). In one or more embodiments, sensor 312 may monitor one or more container parameters at a predetermined timed interval or any interval of time. In one or more embodiments, an information handling system may transmit a request to a sensor 312 and upon receipt of the request the sensor 312 may communicate one or more measurements associated with one or more container parameters of an associated container to the information handling system. In one or more embodiments, a sensor 312 monitors or detects one or more container parameters of a plurality of containers 202.

In one or more embodiments, mixing system 140 may be coupled to, engaged with or integral to the trailer 302. In one or more embodiments, mixing system 140 may be fixed or stationary at site 300 and trailer 302 is maneuvered to position the opening 304 over the mixing system 140. In one or more embodiments, the trailer 302 is positioned at a site 300 and mixing system 140 is arranged so that the mixing system 140 aligns with the opening 304. In one or more embodiments, a container support structure 100 or the containers 202, for example, containers 202A-D, may be positioned at or proximate to an end of the trailer 302 (for example, proximate to wheels 308 at a distal or rear end or at a head end proximate to hitch 306) to allow a hoisting mechanism 206 to engage a container 202C from an end of the trailer 302 or a side of the trailer 302. In one or more embodiments, mixing system 140 may be disposed on, within, about or below trailer 302.

Figure 4:
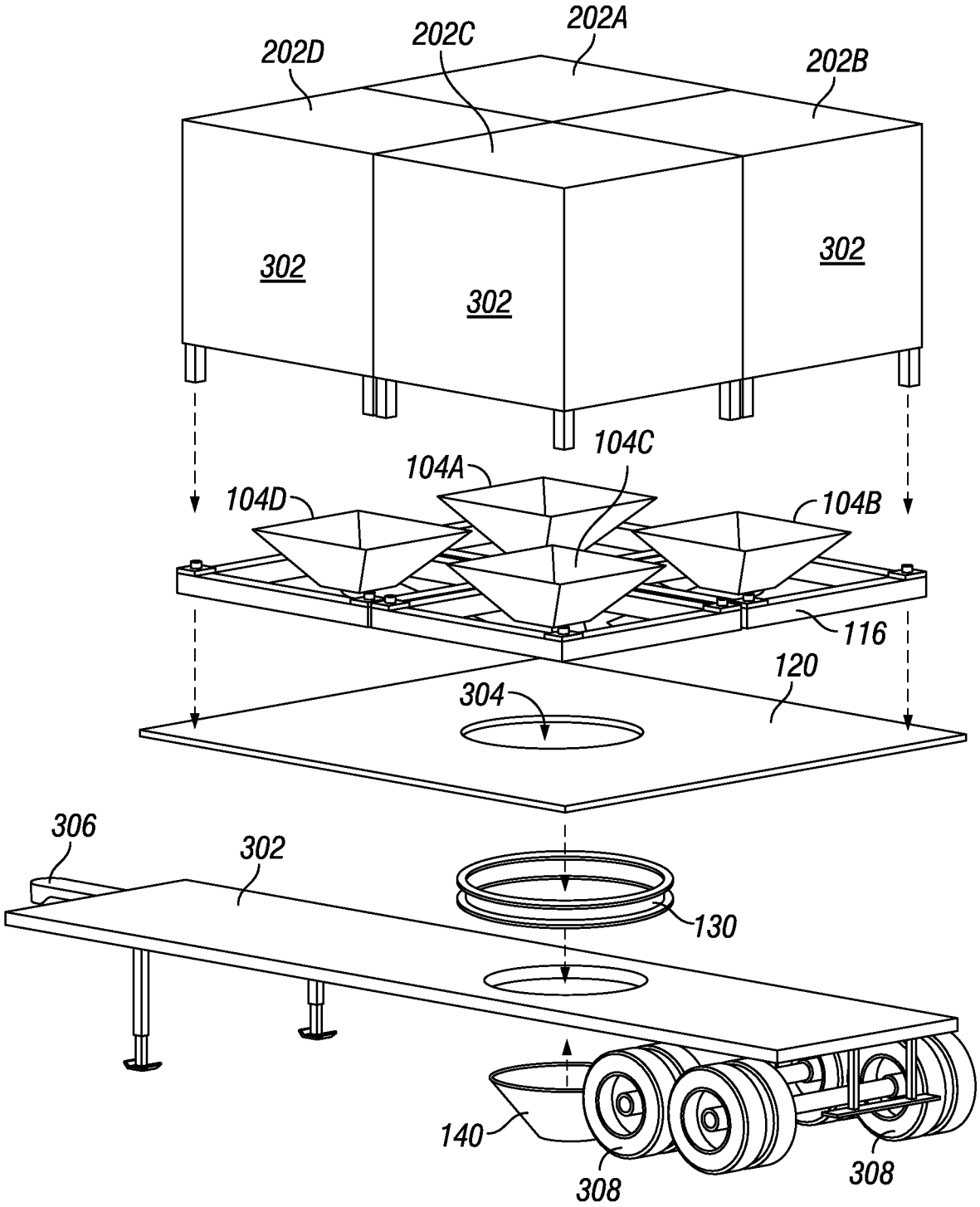
FIG. 4 is a schematic block diagram of a container configuration, in accordance with one or more aspects of the present disclosure.

FIG. 4 is a schematic block diagram of a container configuration, in accordance with one or more aspects of the present disclosure. One or more receptacles 104 are coupled to a frame 116. In one or more embodiments, any one or more receptacles 104 may be coupled to a container 202. Containers 202A, 202B, 202C and 202D are positioned on a frame 116 and above one or more receptacles 104. Frame 116 aligns with a rotary table 120. Rotary table 120 aligns with a motor mechanism 130. Motor mechanism 130 aligns with an opening 304 of a trailer 302. Opening 304 aligns with a mixing system 140.

Figure 5:
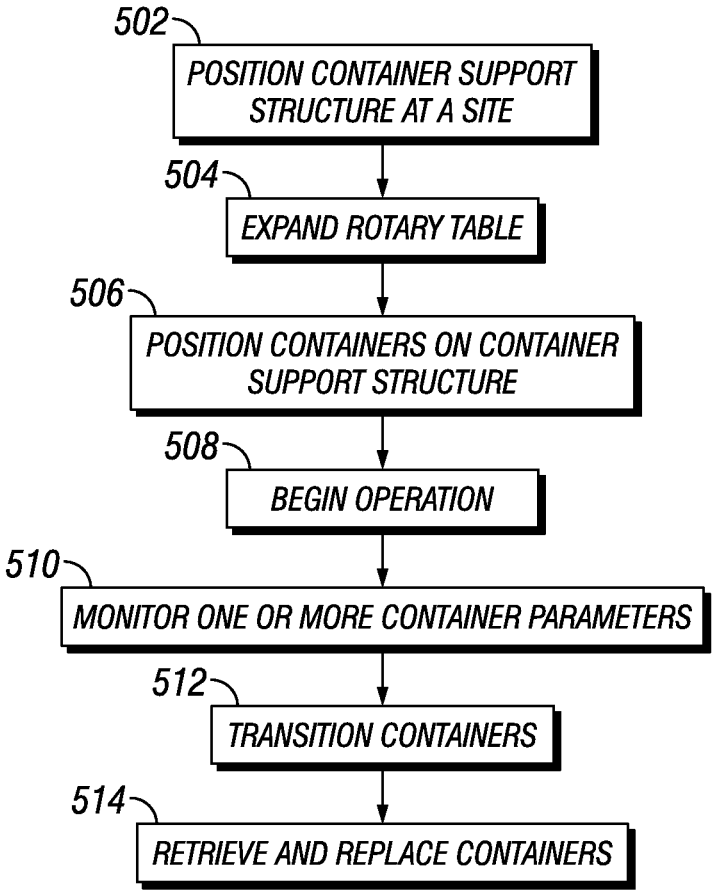
FIG. 5 is a flowchart for arrangement of one or more containers at a site, in accordance with one or more aspects of the present disclosure.

FIG. 5 is a flowchart for arrangement of one or more containers at a site, in accordance with one or more aspects of the present disclosure. At step 502, a container support structure (for example, container support structure 100 of FIG. 1 and FIG. 2) is positioned at a site. In one or more embodiments, container support structure 100 may be positioned at or about a hopper or mixing system (such as, mixing system 140 of FIG. 1, FIG. 2, FIG. 3 and FIG. 4) by positioning an opening (for example, opening 304 of FIG. 3) above a mixing system 140. The container support structure 100 may be positioned at a location at the site that has been prepared for the container support structure 100. For example, the location may be smoothed and flattened or tamped to allow ease of mobility of a transportation unit that removes and replaces one or more containers (for example, containers 202 of FIG. 2, FIG. 3 and FIG. 4) of the container support structure 100. In one or more embodiments, a ground surface of a location may be temporarily covered with a hard flooring or tiles to provide a smooth, flat surface. One or more operations requiring the container support structure 100 may require that numerous containers be retrieved from and replaced on the container support structure 100 and thus the location for the container support structure 100 may be proximate to a storage area of sufficient size to contain the required number of empty containers 202 and filled or loaded containers 202 (for example, containers filled with a material 314 of FIG. 3 such as a bulk material used in a hydrocarbon pumping operation).

At step 504, the rotary table (for example, rotary table 120 of FIG. 1, FIG. 2, FIG. 3 and FIG. 4) is expanded or unfolded. The rotary table 120 may expand or unfold so as to support a plurality of containers 202. For example, the rotary table 120 may expand or unfold to support four containers 202A, 202B, 202C and 202D.

At step 506, one or more containers 202 are positioned or disposed on or about the container support structure 100. For example, an operation may require that materials be discharged at a certain discharge rate with a certain composition or mixture. In one or more embodiments, material 314 may be initially discharged from a container at the front right of the trailer 202, container 202A, for a left hand rotary table 120 rotation or at the left front of the trailer 202, container 202D, for a right hand rotary table 120 rotation. For example, for a left hand or counter clockwise rotation, a container 202A discharges material 314 to a mixing system 140 a first rate. Container 202A may server as the primary material delivery container. When container 202A approaches empty or a threshold level (such as 10% material 314 remaining for discharge) the rotary table 120 is actuated to start rotating to the left by 90 degrees. After rotating the rotary table 120 by 90 degrees, a primary container is once again in the top left position and ready for discharge of material 314 to the mixing system 140 at the desired rate.

In one or more embodiments, an operation may require that a plurality of materials 314 from multiple containers 202 are discharged into a mixing system 140 where any one or more containers 202 comprise different types of materials 314 from any one or more other containers 314. For example, container 202A may comprise a first material 314 while container 202B comprises a second material 314. The second material 314 may be discharged from container 202B at any time, for example, upon rotation of container 202B from the bottom right position to the bottom left position. In one or more embodiments, a container may be removed and replaced when a threshold level of material is reached. For example, in one or more operations only a certain amount of a second material is required and thus once container 202B has discharged the threshold amount of the second material 314 (such as 20% of the second material 314), the container 202B is removed and replaced with a different container 202. In one or more embodiments, any number of different types of materials 314 may be discharged from any one or more containers 202 at the same time, based on a threshold of remaining material 314 in any one or more containers 202, at a timed interval or based on any other timing or threshold. In one or more embodiments, once the containers 202 are empty or sufficiently empty, containers 202 may be replaced with a new or replacement container 202 containing or filled with the required material. In one or more embodiments, any number of containers 202 are initially positioned or disposed on or about the container support structure 100. For example, a container 202A may initially be positioned or disposed on or about the container support structure 100. In another example, any one or more of containers 202A, 202B, 202C and 202 D are positioned or disposed on or about the container support structure 100.

At step 508, an operation may begin. An operation may be started by transitioning a gate or valve of any one or more of containers 202 positioned or disposed on or about the container support structure 100. In one or more embodiments, an operation may require discharge of material from any one or more containers 202 at a specific discharge rate any period of time. In one or more embodiments, the material from any one or more of the containers 202 may be discharged into a mixing system 140.

At step 510, one or more container parameters of each container 202 are monitored. For example, containers 202A, 202B, 202C and 202D may be positioned or disposed about a container support structure 100. Each container 202 may initially be filled with a material. Each container 202 may be filled with the same material, different materials, or any combination of materials. One or more container parameters of each of the containers 202 may be monitored by an information handling system (for example, information handling system 600 of FIG. 6) that comprises one or more instructions that are executed by a processor to cause the processor to perform any one or more steps of any one or more embodiments. In one or more embodiments, each container 202 may comprise a sensor, for example, a sensor 312 of FIG. 3. The information handling system 600 may receive one or more measurements from the sensor 312 that are indicative of a one or more container parameters associated with any one or more containers 202. In one or more embodiments, containers 202 do not include a sensor 312 and the one or more container parameters associated with any one or more containers 202 is monitored manually, for example, by observation of a gauge, meter or other detector at or about each respective container 202.

At step 512, one or more containers 202 are transitioned based, at least in part, the one or more container parameters associated with the one or more containers 202. The one or more containers are transitioned from a first position to a second position by rotating the rotary table 120. For example, a command may be communicated from the information handling system 600 to the motor mechanism 130 which causes rotation of the rotary table 120 by specified amount of degrees in a clockwise or counterclockwise direction. In one or more embodiments, the motor mechanism 130 may be manually controlled. For example, the motor mechanism 130 may rotate the rotary table 120 by 90 degrees such that a container 202 of FIG. 4 may be rotated between four different positions.

At step 514, one or more containers 202 are retrieved and one or more new or replacement containers 202 are positioned or disposed on or about the frame 116 or the support platform 210 or trailer 302. For example, a container support structure 100 may comprise four containers 202A, 202B, 202C and 202D positioned or disposed at a first position, a second position, a third position and a fourth position respectively. Any one or more containers 202 may be selected to discharge material. The material of the one or more containers 202 may be discharged at a specified rate of discharge. The rate of discharge may remain constant or vary. The one or more containers 202 may be filled to a specified load level or weight. Any one or more container parameters associated with the one or more containers 202 is monitored. Replacement or retrieval of the one or more containers 202 may be determined based, at least in part on the one or more measurements indicative of the one or more container parameters, one or more measurements from any one or more sensors 312, one or more replacement parameters, a load level threshold, a discharge rate threshold, any other parameters or any combination thereof.

In one or more embodiments, a container 202 is selected to discharge material into mixing system 140. For example, Information handling system 600 may receive one or more measurements from a sensor 312 associated with a container 212A that are indicative of one or more container parameters or one or more container parameters may be determined manually. Based, at least in part, on the one or more measurements, a container may be selected to discharge material or a container may be selected for retrieval. For example, the one or more measurements may be analyzed to determine if one or more parameters have reached, exceed or fallen below a load level threshold, a discharge rate threshold or any other threshold. The one or more measurements may also be analyzed by information handling system 600 or manually to determine or estimate a remaining discharge time of a container. For example, an information handling system 600 may determine based, at least in part, on a discharge rate of a container 202, the one or more measurements, a comparison of the one or more measurements to a load level threshold, a discharge threshold or both that the container 202 the remaining discharge time or a time when container 202 will be empty or have an insufficient amount of material to maintain a required discharge rate. A remaining discharge time may be based, at least in part, on the type of material contained in a container 202, rate of discharge from the container 202, required discharge rate of material for the operation, number of containers 202 currently discharging material into mixing system 140 any other parameter or any combination thereof. The remaining discharge time may be compared to a discharge time threshold to determine if the remaining discharge time has reached, exceeded or fallen below the discharge time threshold.

A container 202, may be transitioned from a first position to a second position based, at least in part, on any one or more replacement parameters. For example, the one or more replacement parameters may include, but are not limited to, remaining discharge time, discharge time threshold, comparison of a remaining discharge time to a discharge threshold, a load level, a load level threshold, a comparison of the load level to the load level threshold, number of available containers 202, number of currently discharging containers 202, type of material being discharged from any one or more containers 202, required rate of discharge of material, or any other parameter. For example, a first container 202A may be selected to discharge material to a mixing system 140, while second container 202B, third container 202C and fourth container 202D are not selected to discharge material. To obtain the desired discharge rate may require a plurality of containers to discharge material while the first container 202A is discharging material. The third container 202C may be selected based, at least in part, on third container 202C being positioned in the third position, any one or more container parameters, replacement parameters, any other parameter or any combination thereof. The third container 202C may be selected to discharge materials at substantially the same time as the first container 202A or any time after first container 202A has started discharging material. In one or more embodiments, the amount of material 314 required may be provided by any one or more container support structures 100 comprising any one or more containers 202.

In one or more embodiments, rotary table 120 may rotate containers 202 while material is being discharged from any one or more containers 202. For example, a first container 202A may be selected to discharge material into mixing system 140. Based on any one or more container parameters, replacement parameters, any other parameter or any combination thereof, material may be discharged from a third container 202C into mixing system 140 even though the first container 202A is still discharging material. The rotary table 120 may rotate the containers 202 while corresponding material is discharged from the first container 202A and the third container 202C to align the first container 202A and third container 202C in a position such that a transport device or hoisting mechanism 206 may easily retrieve the first container 202A, the third container 202C, or both. For example, the first container 202A may be transitioned to a retrieval position (for example, the second position) as the first container 202A is discharging the last amounts of material such that the first container 202A is positioned to be retrieved once the material has been emptied or substantially emptied from the first container 202A. A replacement or new container 202 may be positioned to replace the retrieved first container 202A or the rotary table may be rotated to a replacement position (for example, the third position) whereupon a replacement or new container 202 is disposed or position on or about the frame 116. In one or more embodiments, a configuration of a container support structure 100 may require that the primary material 314 (the material with the highest volume requirement for the desired mixture) be placed a specified position, for example, at the top right.

In one or more embodiments, the first container 202A may be transitioned from the first position to the second positioned or retrieved from the container support structure 100 based, at least in part, on any one or more replacement parameters. For example, the first container 202A may be selected for retrieval from the first position or transition to a second position based, at least in part, on the one or more replacement parameters. Prior to retrieval of the first container 202A, a second container 202B may be selected to discharge material into mixing system 240 such that the discharge rate of material is maintained at the required discharge rate. In one or more embodiments, the second container 202B is selected to discharge material into mixing system 240 based, at least in part, on any one or more replacement parameters associated with any one or more containers 202, any one or more container parameters, any other parameter or any combination thereof. For example, for a period of time both the first container 202A and second container 202B may discharge material into mixing system 140 so that the required discharge rate is maintained. As the discharge rate of container 202A decreases, the discharge rate of container 202B may be increased.

In one or more embodiments, once the first container 202A is selected for replacement or retrieval, the first container 202A may be retrieved from the first position by a transport device or hoisting mechanism 206, for example, a forklift. The motor mechanism 130 may rotate the rotary table 120 causing the frame 116 to rotate by 90 degrees to align the second container 202B in the third position (replacing the third container 202C), the third container 202C to the fourth position (replacing the fourth container 202D), the fourth container 202D to the first position (the position where the first container 202A has been retrieved from) leaving the second position open. A fifth container 202 or a new or replacement container 202 may be selected and positioned or disposed at or about the frame 116 in the second position. In one or more embodiments, once the first container 202A is selected for replacement or retrieval, the first container 202A is transitioned to the second position by rotating the rotary table 120 by 90 degrees to align the first container 202A in the second position, the second container 202B in the third position and the third container 202C in the fourth position and the fourth container 202D in the first position. The first container 202A may then be retrieved from the second position and a fifth container 202 or a new or replacement container 202 may be selected and positioned or disposed at or about the frame 116 in the second position.

In one or more embodiments, a container support structure 100 may be installed on a trailer 302 which permits a hoisting mechanism 206 to retrieve or replace a container 202 from only three sides. A container 202 is positioned or placed such that as the container is rotated on the rotary table 120 by 90 degrees, the hoisting mechanism 206 can retrieve the container 202 from any of at least three positions. In one or more embodiments, the container support structure 100 may be positioned on a ground surface and a hoisting mechanism 206 may retrieve and replace a container 202 from any position.

In one or more embodiments, the container 202 selected for retrieval, replacement or both may be retrieved, replaced or both when in any position. In one or more embodiments, a plurality of containers 202 may be selected for retrieval, replacement or both. For example, as the second and fourth positions and the first and third positions are on opposite sides of the container support structure 100, containers 202 located at these positions (for example, second container 202B and fourth container 202D) may be retrieved and replaced at the same time. For example, a first hoisting mechanism (for example, hoisting mechanism 206A of FIG. 2) and a second hoisting mechanism (for example, hoisting mechanism 206B of FIG. 2) may be disposed or positioned at a site 200 to retrieve, replace and arrange containers 202. As the first hoisting mechanism 206A and second hoisting mechanism 206B operate with respect to containers 202 that are opposite each other or are on opposite sides of the support platform 210, first hoisting mechanism 206A and second hoisting mechanism 206B may operate without interfering with the operation of each other. To increase efficiency of retrieval, replacement and arrangement of containers 202, two or more transport devices or hoisting mechanisms 206 may be utilized. In one or more embodiments, one or more containers 202 may be selected for discharge of material, for example, first container 202A and third container 202C of FIG. 2. In one or more embodiments, once it is determined that first container 202A and third container 202C should be removed, replaced or both, the transport devices or hoisting mechanisms 206 may remove or replace first container 202A and third container 202C while in the first position and third position, respectively. In one or more embodiments, once it is determined that first container 202A and third container 202C are selected for retrieval or replacement, the rotary table 120 may be rotated by 90 degrees such that the first container 202A and third container 202C are in the second position and the fourth position, respectively, and once in the second position and fourth position, the first container 202A and the third container 202C may be removed, replaced or both. Any one or more combinations of selection, retrieval and replacement of containers 202 are contemplated.

In one or more embodiments, a container 202 may be selected for removal and removed while in a first position and a replacement or new container 202 may be disposed or positioned on or about the container support structure 100 after the rotary table 120 has been rotated to a second position. For example, the first container 202A may be selected for removal. A transport device or hoisting mechanism 206 may remove the first container 202A while the first container 202A is in a first position and after removal of the container 202A, the rotary table 120 may be rotated, for example, rotated by 90 degrees. A replacement container 202 or new container 202 may be disposed or positioned on or about the container support structure 100 after any rotation of rotary table 120. For example, a container 202 may be removed when at a first position and a replacement container 202 may be disposed or positioned on or about the container support structure 100 at a third position.

Additionally, in one or more embodiments, any two or more containers 202 may be removed or replaced at any one or more positions. For example, an operation may require that two or more containers 202 discharge material at or about the same time or at a staggered interval or any other time interval. Hoisting mechanism 206A may remove second container 202B from a second position while at substantially the same time or at a later time interval hoisting mechanism 206B may remove fourth container 204D from a fourth position. The rotary table 120 may be rotated by 90 degrees such that no containers 202 are disposed or positioned at a first position and third position. Hoisting mechanism 206A may dispose or position on or about the container support structure 100 a first replacement container 202 in the first position and hoisting mechanism 206B may dispose or position a second replacement container 202 at the third position. The present disclosure contemplates any combination of positions for removal, replacement or both of containers 202.

Any one or more removed containers 202 may be positioned on another container support structure 100, a transportation unit for transporting the empty containers 202 away from the site or any other location at the site. It should be noted that the same transportation unit used to provide one or more filled containers 202 to the site may then be utilized to remove one or more empty containers 202 from the site.

As two or more transport devices or hoisting mechanisms 206 may operate at the same time at the same location, efficiency of retrieval, replacement and arrangement of one or more containers 202 is improved. Further, the time to implement each removal or replacement of a container 202 may be extended as two or more transport devices or hoisting mechanisms 206 may be operated at the same time as opposed to a single transport device or hoisting mechanism 206. Further, as the elevation of the containers 202 is closer to the ground or surface at the site than current systems, the transport devices or hoisting mechanisms 206 may take less time to remove and replace a container 202 and a lower elevation of the containers 202 creates a safer operating environment.

Figure 6:
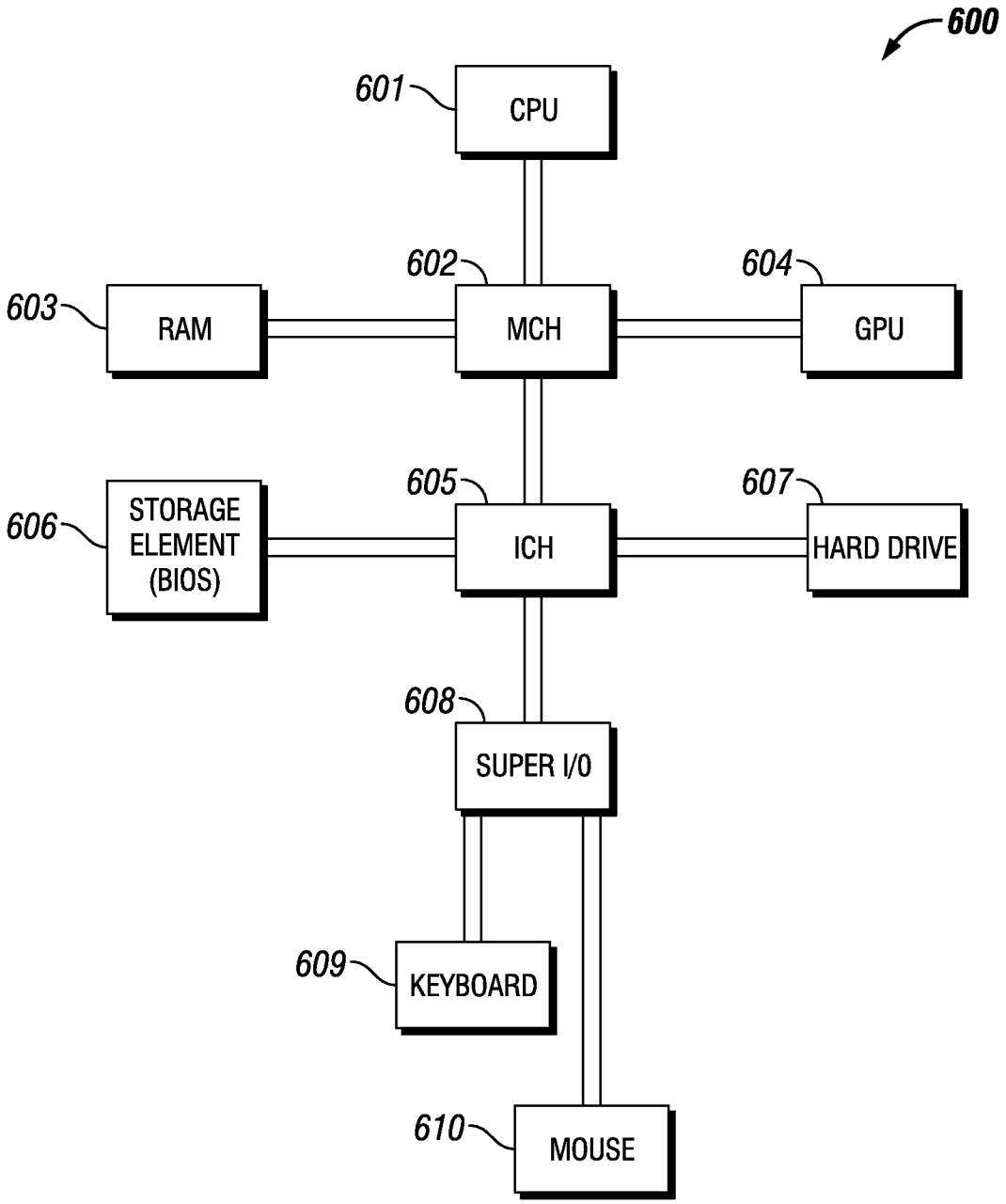
FIG. 6 is a diagram of an example information handling system, according to one or more aspects of the present disclosure.

FIG. 6 is a diagram illustrating an example information handling system 600, according to one or more aspects of the present disclosure. Any information handling system and any component discussed that includes a processor may take a form similar to the information handling system 600 or include one or more components of information handling system 600. A processor or central processing unit (CPU) 601 of the information handling system 600 is communicatively coupled to a memory controller hub (MCH) or north bridge 602. The processor 601 may include, for example a microprocessor, microcontroller, digital signal processor (DSP), application specific integrated circuit (ASIC), or any other digital or analog circuitry configured to interpret, execute program instructions, process data, or any combination thereof. Processor (CPU) 601 may be configured to interpret and execute program instructions or other data retrieved and stored in any memory such as memory 603 or hard drive 607. Program instructions or other data may constitute portions of a software or application for carrying out one or more methods described herein. Memory 603 may include read-only memory (ROM), random access memory (RAM), solid state memory, or disk-based memory. Each memory module may include any system, device or apparatus configured to retain program instructions, program data, or both for a period of time (e.g., computer-readable non-transitory media). For example, instructions from a software or application may be retrieved and stored in memory 603 for execution by processor 601. Modifications, additions, or omissions may be made to FIG. 6 without departing from the scope of the present disclosure. For example, FIG. 6 shows a particular configuration of components of information handling system 600. However, any suitable configurations of components may be used. For example, components of information handling system 600 may be implemented either as physical or logical components. Furthermore, in some embodiments, functionality associated with components of information handling system 600 may be implemented in special purpose circuits or components. In other embodiments, functionality associated with components of information handling system 600 may be implemented in configurable general purpose circuit or components. For example, components of information handling system 600 may be implemented by configured computer program instructions.

Memory controller hub (MCH) 602 may include a memory controller for directing information to or from various system memory components within the information handling system 600, such as memory 603, storage element 606, and hard drive 607. The memory controller hub 602 may be coupled to memory 603 and a graphics processing unit (GPU) 604. Memory controller hub 602 may also be coupled to an I/O controller hub (ICH) or south bridge 605. I/O controller hub 605 is coupled to storage elements of the information handling system 600, including a storage element 606, which may comprise a flash ROM that includes a basic input/output system (BIOS) of the computer system. I/O controller hub 605 is also coupled to the hard drive 607 of the information handling system 600. I/O controller hub 605 may also be coupled to a Super I/O chip 608, which is itself coupled to several of the I/O ports of the computer system, including keyboard 609 and mouse 610.

In one or more embodiments, an information handling system 600 may comprise at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), or any other types of nonvolatile memory. Additional components of the information handling system may include one or more disk drives, one or more network ports for communication with external devices as well as various I/O devices, such as a keyboard, a mouse, and a video display. The information handling system may also include one or more buses operable to transmit communications between the various hardware components.

In one or more embodiments, a container system comprises a frame, at least four containers disposed about the frame, wherein the at least four containers are removable, a rotary table coupled to the frame, a motor mechanism coupled to the rotary table, wherein the motor mechanism rotates the rotary table to arrange the at least four containers at one or more positions and wherein the motor mechanism, the rotary table and the frame are aligned such that material from at least one of the at least four containers is discharged through an opening to a mixing system. In one or more embodiments, the motor mechanism rotates the rotary table by 90 degrees to transition a first container of the at least four containers from a first position to a second position of the one or more positions. In one or more embodiments, the container system further comprises a sensor disposed about at least one of the at least four containers, wherein the sensor detects a load level of the at least one of the at least four containers. In one or more embodiments, the container system further comprises a support platform, wherein the frame is disposed on the support platform, and wherein the motor mechanism, the rotary table, the frame and the support platform are aligned such that material from at least one of the at least four containers is discharged through an opening of the support platform to the mixing system. In one or more embodiments, the container system further comprises a hitch coupled to the support platform, wherein the hitch allows the support platform to couple to a transport vehicle.

In one or more embodiments, a method for removal and replacement of containers at a site comprises disposing at least four containers on a frame coupled to a rotary table, discharging a first material from a first container of the at least four containers, wherein the first container is at a first position, determining to remove the first container based, at least in part, on one or more replacement factors associated with the first container, rotating by a first amount the rotary table, removing the first container and disposing a first replacement container on the frame. In one or more embodiments, the method further comprises wherein the at least four containers comprises a second container at a second position, a third container at a third position and a fourth container at a fourth position, wherein each of the at least four containers are arranged in a single layer with two faces of each of the at least four containers adjacent to two faces of two other of the at least four containers, and wherein the second container comprises a second material, the third container comprises a third material and the fourth container comprises a fourth material, discharging a third material from a third container, determining to remove the third container based, at least in part, on one or more replacement factors associated with the third container, removing the third container and disposing a second replacement container on the frame. In one or more embodiments, rotating the rotary table comprises transitioning the first container from the first position to the second position, the second container from the second position to the third position and the third container from the third position to the fourth position. In one or more embodiments, the first container and the third container are removed prior to rotating the rotary table by the first amount. In one or more embodiments, the first container and third container are removed after rotating the rotary table by the first amount. In one or more embodiments, the method further comprises monitoring one or more container parameters associated with at least one of the at least four containers. In one or more embodiments, the method further comprises selecting the third container to discharge the third material, wherein the third material from the third container is selected based, at least in part, on one or more container parameters associated with the at least one of the at least four containers. In one or more embodiments, the rotary table is rotated while the first material is being discharged from the container and the third material is being discharged from the third container. In one or more embodiments, the method further comprises receiving one or more measurements from one or more sensors associated with the first container, wherein the determining to remove the first container is based, at least in part, on the one or more measurements. In one or more embodiments, the method further comprises disposing the frame on a support platform.

In one or more embodiments, a container arrangement method comprises coupling a motor mechanism to a rotary table, wherein the motor mechanism rotates the rotary table, coupling a frame to the rotary table and positioning the motor mechanism, the frame and the rotary table to align with an opening, wherein the opening allows a material discharged from one or more containers disposed on the frame to flow into a mixing system, wherein the rotary table supports at least four containers arranged in a single layer with at least two faces of each of the at least four containers adjacent to two faces of two other of the at least four containers disposed on the frame. In one or more embodiments, the method further comprises coupling the motor mechanism to a support platform. In one or more embodiments, the method further comprises positioning the at least four containers on the frame. In one or more embodiments, the method further comprises disposing one or more sensors on at least one of the at least four containers. In one or more embodiments, the method further comprises coupling an information handling system to at least one of the one or more sensors.

Although the present disclosure and its advantages have been described in detail, it should be understood that various changes, substitutions and alterations can be made herein without departing from the spirit and scope of the disclosure as defined by the following claims.

What is claimed is:

1. A container system, comprising:

a frame;

at least four containers disposed about the frame, wherein the at least four containers are removable;

a sensor disposed about at least one of the at least four containers, wherein the sensor detects a load level of the at least one of the at least four containers;

a rotary table coupled to the frame;

a motor mechanism coupled to the rotary table, wherein the motor mechanism rotates the rotary table to arrange the at least four containers at one or more positions; and wherein the motor mechanism, the rotary table and the frame are aligned such that material from at least one of the at least four containers is discharged through an opening to a mixing system.

2. The container system of claim 1, wherein the motor mechanism rotates the rotary table by 90 degrees to transition a first container of the at least four containers from a first position to a second position of the one or more positions.

3. The container system of claim 1, further comprising a support platform, wherein the frame is disposed on the support platform, and wherein the motor mechanism, the rotary table, the frame and the support platform are aligned such that material from at least one of the at least four containers is discharged through an opening of the support platform to the mixing system.

4. The container system of claim 3, further comprising a hitch coupled to the support platform, wherein the hitch allows the support platform to couple to a transport vehicle.

5. The container system of claim 1, wherein the at least four containers comprise a first container at a first position, a second container at a second position, a third container at a third position and a fourth container at a fourth position, wherein each of the at least four containers are arranged in a single layer with two faces of each of the at least four containers adjacent to two faces of two other of the at least four containers, and wherein the first container comprises a first material, the second container comprises a second material, the third container comprises a third material and the fourth container comprises a fourth material.

6. The container system of claim 5, wherein:

the first material is discharged from the first container;

the rotary table is rotated by a first amount after discharging the first material;

the first container is removed; and a replacement container is disposed on the frame.

7. The container system of claim 6, wherein the first material from the first container is selected for discharge based, at least in part, on one or more container parameters associated with the at least one of the at least four containers.

8. The container system of claim 6, wherein the rotary table is rotated while the first material is being discharged from the container.

9. The container system of claim 6, wherein the first container is removed based, at least in part, on one or more measurements from one or more sensors associated with the first container.

10. The container system of claim 5, wherein the rotary table is rotated to transition the first container from the first position to the second position, the second container from the second position to the third position and the third container from the third position to the fourth position.

11. A container arrangement method, comprising:

disposing at least four containers on a frame, wherein the at least four containers are removable;

disposing one or more sensors on at least one of the at least four containers;

coupling a rotary table to the frame; and coupling a motor mechanism to the rotary table, wherein the motor mechanism rotates the rotary table to arrange the at least four containers at one or more positions, wherein the motor mechanism, the rotary table and the frame are aligned such that material from at least one of the at least four containers is discharged through an opening to a mixing system.

12. The container arrangement method of claim 11, further comprising arranging each of the at least four containers in a single layer with two faces of each of the at least four containers adjacent to two faces of two other of the at least four containers.

13. The container arrangement method of claim 11, further comprising coupling the motor mechanism to a support platform.

14. The container arrangement method of claim 13, further comprising aligning the motor mechanism, the rotary table, the frame and the support platform such that material from at least one of the at least four containers is discharged through an opening of the support platform to the mixing system.

15. The container arrangement method of claim 11, further comprising positioning the at least four containers on the frame.

16. The container arrangement method of claim 11, further comprising coupling an information handling system to at least one of the one or more sensors.

17. The container arrangement method of claim 11, wherein the motor mechanism rotates the rotary table by 90 degrees to transition a first container of the at least four containers from a first position to a second position of the one or more positions.

18. The container arrangement method of claim 11, further comprising:

discharging a first material from a first container of the at least four containers;

rotating the rotary table by a first amount after discharging the first material;

removing the first container; and disposing a replacement container on the frame.

19. The method of claim 18, wherein the first container is removed based, at least in part, on one or more measurements from one or more sensors associated with the first container.

20. The method of claim 11, wherein the sensor detects a load level of the at least one of the at least four containers.

21. The method of claim 11, further comprising detecting a load level of at least one of the at least four containers.

22. The method of claim 11, further comprising removing at least one container in response to, at least in part, on one or more measurements from one or more sensors associated with the at least one container.

23. The method of claim 11, further comprising replacing the at least one container removed with another container.

24. A container system, comprising:

a frame;

at least four containers disposed about the frame, wherein the at least four containers are removable;

a rotary table coupled to the frame;

a motor mechanism coupled to the rotary table, wherein the motor mechanism rotates the rotary table to arrange the at least four containers at one or more positions;

wherein the motor mechanism, the rotary table and the frame are aligned such that material from at least one of the at least four containers is discharged through an opening to a mixing system;

wherein the at least four containers comprise a first container at a first position, a second container at a second position, a third container at a third position and a fourth container at a fourth position, wherein each of the at least four containers are arranged in a single layer with two faces of each of the at least four containers adjacent to two faces of two other of the at least four containers, and wherein the first container comprises a first material, the second container comprises a second material, the third container comprises a third material and the fourth container comprises a fourth material;

wherein:

the first material is discharged from the first container;

the rotary table is rotated by a first amount after discharging the first material;

the first container is removed; and a replacement container is disposed on the frame;

and wherein the first container is removed based, at least in part, on one or more measurements from one or more sensors associated with the first container.

25. The container system of claim 24, wherein the sensor detects a load level of the at least one of the at least four containers.

26. The container system of claim 24, further comprising an information handling system coupled to at least one of the one or more sensors.

27. The container system of claim 24, wherein the rotary table is rotated to transition the first container from the first position to the second position, the second container from the second position to the third position and the third container from the third position to the fourth position.

28. The container system of claim 24, wherein the first material from the first container is selected for discharge based, at least in part, on one or more container parameters associated with the at least one of the at least four containers.

29. The container system of claim 24, wherein the rotary table is rotated while the first material is being discharged from the container.

30. The container system of claim 1, further comprising an information handling system coupled to at least one of the one or more sensors.

* * * * *